United States Patent [19]

Brouwer et al.

[11] Patent Number: 4,471,818

[45] Date of Patent: Sep. 18, 1984

[54] FLUID WEFT INSERTION LOOM MONITORING SYSTEM

[75] Inventors: Charles W. Brouwer, East Greenwich, R.I.; Larry C. Cowan, York, S.C.

[73] Assignee: Leesona Corporation, Warwick, R.I.

[21] Appl. No.: 436,460

[22] Filed: Oct. 25, 1982

Related U.S. Application Data

[62] Division of Ser. No. 223,203, Jan. 7, 1981, Pat. No. 4,362,189.

[51] Int. Cl.[3] ..... D03D 47/30

[52] U.S. Cl. ..... 139/435

[58] Field of Search ..... 139/435, 336, 370.2

[56] References Cited

U.S. PATENT DOCUMENTS

| | | | |
|---|---|---|---|
| 3,451,438 | 6/1969 | Wilde et al. | 139/336 |
| 3,563,281 | 2/1971 | Pfarrwaller | 139/336 |
| 3,940,954 | 3/1976 | Romoli | 139/336 |
| 4,381,803 | 5/1983 | Weidmann et al. | 139/370.2 |

*Primary Examiner*—Henry Jaudon

*Attorney, Agent, or Firm*—Burnett W. Norton

[57] ABSTRACT

The admission of pressurized fluid into the weft insertion nozzle of a loom is detected by an electrical signal generating means arranged in the nozzle in communication with the fluid delivery passage through the nozzle, the generating means generating a signal indicative of such fluid admission and applying the same to a conductor extending to an exterior point for use in monitoring the proper operation of the loom. Preferably, the signal generating means is fluid pressure responsive, such as a piezoelectric crystal exposed to the fluid pressure in the nozzle passage.

6 Claims, 3 Drawing Figures

FLUID WEFT INSERTION LOOM MONITORING SYSTEM

CROSS-REFERENCE TO RELATED APPLICATIONS

This application is a division of co-pending application Ser. No. 223,203, filed Jan. 7, 1981, now U.S. Pat. No. 4,362,189.

Field of The Invention

This invention relates to the field of fluid weft insertion looms equipped with a weft propulsion nozzle to which a pressurized fluid is introduced for the projection of a length of weft through the shed of the loom and is concerned more particularly with a detecting unit for detecting the introduction of pressurized fluid into the propulsion nozzle and providing an electrical signal indicative of the occurrence of this event.

BACKGROUND OF THE INVENTION

In a constant search for increased production, the textile industry in very recent times has heavily focussed on the use of looms for weaving fabric in which the filling or weft yarn is inserted by means of a flowing stream of a pressurized fluid, such as air or water. Such looms eliminate the necessity for a mechanical shuttle as the vehicle for projecting the weft yarn during weaving together with the mechanical driving mechanisms necessitated by a shuttle, and consequently offer inherent advantages from the standpoint of increased operation, simplified mechanical construction, and decreased operating noise, all of which are significantly desirable.

In a conventional shuttle operated loom, all of its elements are mechanically interrelated to the operation of a crankshaft and, consequently, the synchronization of the timing of the various significant events which transpire during each weaving cycle can be readily coordinated and adjusted relative to the rotation of the crankshaft. In a loom where the filling is propelled by a pressurized fluid stream, however, all of the significant operating events need no longer be directly related to crankshaft rotation and consequently it becomes more difficult to insure that the timing of these events is brought into the precise synchronism required for high speed operation.

Furthermore, where some of the instrumentalities employed in fluid weft insertion looms are operating independently of the crankshaft, when defective operation does occur, as will necessarily happen occasionally, it is considerably more difficult to trace the cause of a particular defective pick than was the case with conventional mechanically engineered looms.

It will be apparent that the introduction of pressurized fluid to the weft propulsion nozzle of the fluid weft insertion loom is the primordial event in the cycle of operation of that loom. That is to say, until the pressurized fluid has been delivered to the weft propulsion nozzle, the delivery of the length of weft across the shed of a loom remains an impossibility. Hence, all subsequent events in the successful completion of the loom operating cycle depend upon nozzle pressurization as the initiating event and in the absence of successful completion of this initiating event, all other events become irrelevant and indeed nonexistent. Consequently, it is important in controlling the operation of the loom operating cycle to be able to precisely identify the occurrence as well as the instantaneous timing of the occurrence of nozzle pressurization, and the development of means for accomplishing this objective would be a useful advance in this field.

OBJECTS OF THE INVENTION

The object of the present invention is to provide an improved weft propulsion nozzle for a fluid weft insertion loom which is equipped with a sensing unit for detecting when pressurized fluid is introduced into the nozzle and generating an output signal in response to such detection which can be employed in subsequent control of the operation of the loom.

A further object is the provision of a sensing unit which is responsive to pressure and is arranged in communication with the fluid pressure delivery passage extending through the nozzle so as to be exposed to the level of pressure of the fluid in such passage.

Another object of the present invention is a sensing unit having the capability of detecting both the rise and fall of fluid pressure within the nozzle fluid delivery passage so as to provide an output indication of the end as well as the beginning of the pressurization of the nozzle.

GENERAL DESCRIPTION OF THE INVENTION

In accordance with the present invention, a loom of the type where the weft yarn is projected across its shed by means of a pressurized fluid stream emitted from a projection nozzle is equipped with a sensing unit for detecting the introduction of pressurized fluid to the projection nozzle, which sensing unit is preferably responsive to fluid pressure, such as a piezoelectric crystal, and is arranged within the projection nozzle in communication with the pressurized fluid delivery passage therethrough so as to be exposed to the level of pressure within such passage.

A preferred context for the application of the present invention is the particular fluid weft insertion loom system disclosed in a related application Ser. No. 64,180, filed on Aug. 6, 1979 in the name of Charles W. Brouwer et al and commonly assigned herewith. This application discloses an improved operating loom of the type in question including a yarn storage unit wherein a predetermined length of yarn corresponding to the length to be inserted is metered out from a supply and collected in a storage zone, e.g. wound on a rotating drum, while a downstream end of the yarn reposes within the throat of an injection nozzle, being gripped by a positively acting clamp in the intervening region until just prior to the yarn insertion stage, at which point a pressurized fluid, in this case air or other compressible gas, is delivered virtually instantaneously to the nozzle throat for contact with the yarn reposed therein, the energy contained within the pressurized fluid emitted from the nozzle throat being sufficient to engage the yarn leading end and propel the same across the width of the loom through the shed of the warp threads being consecutively opened and closed in the usual manner of a loom, for eventual receipt at the opposite shed side within a suction tube wherein the yarn end remains until the weaving cycle is completed by the beat up of the newly inserted weft against the fell of the fabric being woven, at which time the exteriorly projecting ends of the beat up weft are sheared by means of shears. While the present invention is especially suitable for association with the loom described in the above identified application, the present invention is not limited in its applicability to that particular loom, or even looms using a compressible gas as the weft propelling medium, but, indeed, will be of equal utility with looms utilizing a noncompressible liquid, such as water, as the propelling medium.

DETAILED DESCRIPTION OF THE INVENTION

While the improved insertion nozzle of this invention incorporating the pressurized fluid sensing unit can be employed in a variety of different control systems, it is preferably used as a part of the overall loom monitoring system of U.S. Pat. No. 4,362,189 mentioned above, and an understanding of the function of the present improvement is best conveyed in general relation to this particular overall system and will be facilitated by the following brief description of that system.

Figure 1:
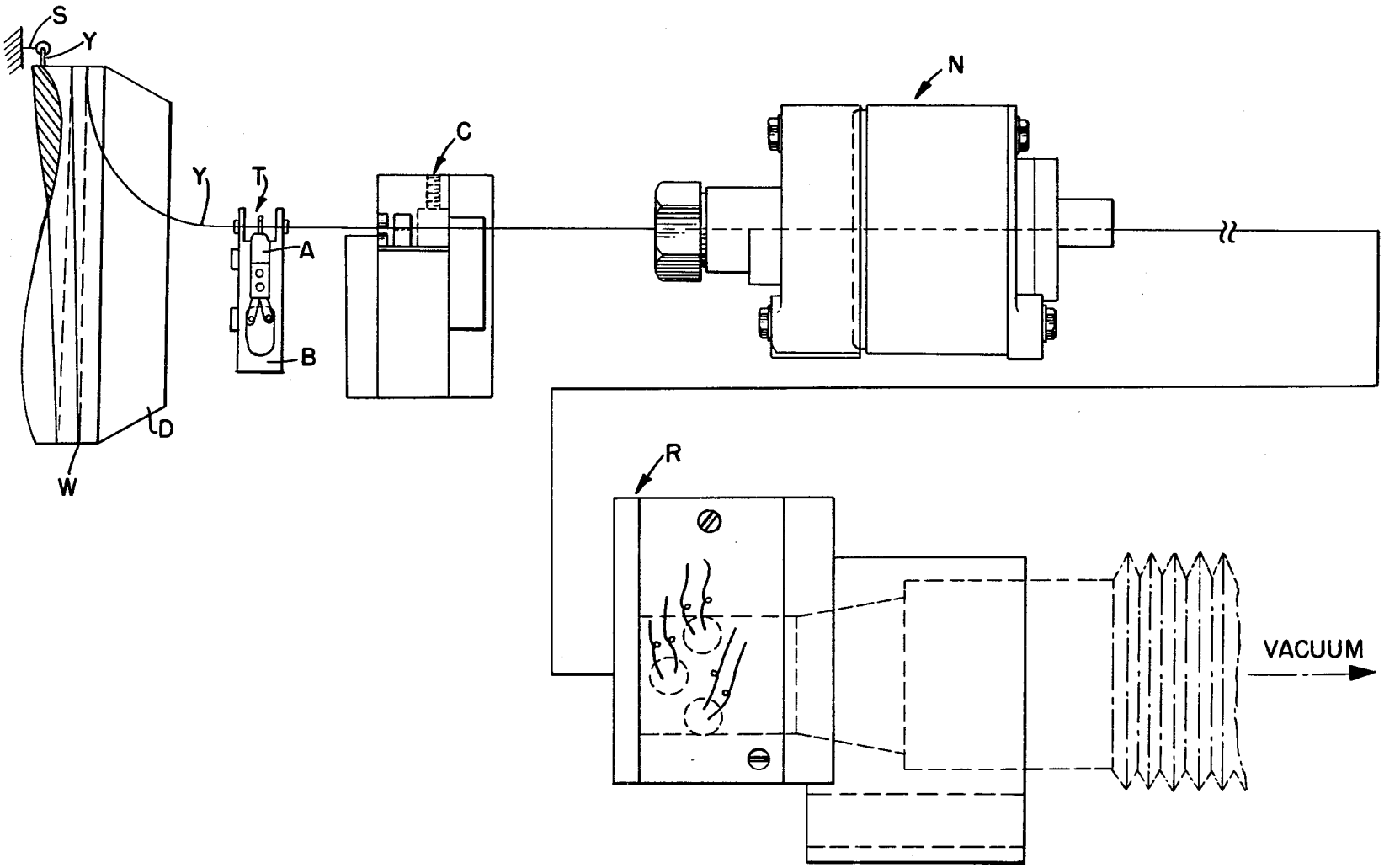
FIG. 1 is a side elevational view, somewhat idealistic, of the several individual event sensing units operative in the monitoring system of the invention arranged in sequence generally in operative relation as in a loom, all of the working parts of the loom, however, including supporting members for the units, etc., being omitted for sake of clarity, except as needed for an adequate understanding of such relation, e.g. of the yarn storage means.

The general relation of the arrangement of the sensing units employed in the preferred overall monitoring system appears in FIG. 1 wherein the components of the loom which have no material relation to the present invention have been omitted for sake of clarity. Thus, all of the interior loom components which form and define the shed, etc., do not appear in FIG. 1, which is broken away to suggest this absence. FIG. 1 does show the end of the yarn metering and storage unit which functions to meter out the appropriate length of yarn according to the width of the loom in question, and store the same in readiness for delivery to the insertion nozzle when needed. The yarn metering and storage unit is the same as disclosed in the above identified related application, Ser. No. 64,180, and for further details of its structure and operation, reference may be had to the disclosure of that application.

As shown in FIG. 1, the yarn Y is delivered from a supply source not shown through a fixed yarn stop in the form, for example, of a guide aperture onto the surface of a storage drum D where it is collected into coils or windings W. From the coils W, the yarn passes through a yarn withdrawal or delivery monitoring unit generally designated T capable of sensing a sudden rise in yarn operating tension incidental to complete withdrawal of the stored yarn supply from storage drum D, a solenoid-actuated yarn clam generally designated C, which positively grips and holds the yarn during its accumulation on the storage drum and then releases the yarn preparatory to the weft insertion phase of the cycle, the weft insertion nozzle generally designated N which when actuated emits a blast of pressurized air through the throat thereof, and a yarn reception unit generally designated R which includes a suction tube for aspirating the leading yarn end therein with an associated sensing unit for sensing the actual arrival of the yarn end therein.

Figure 2:
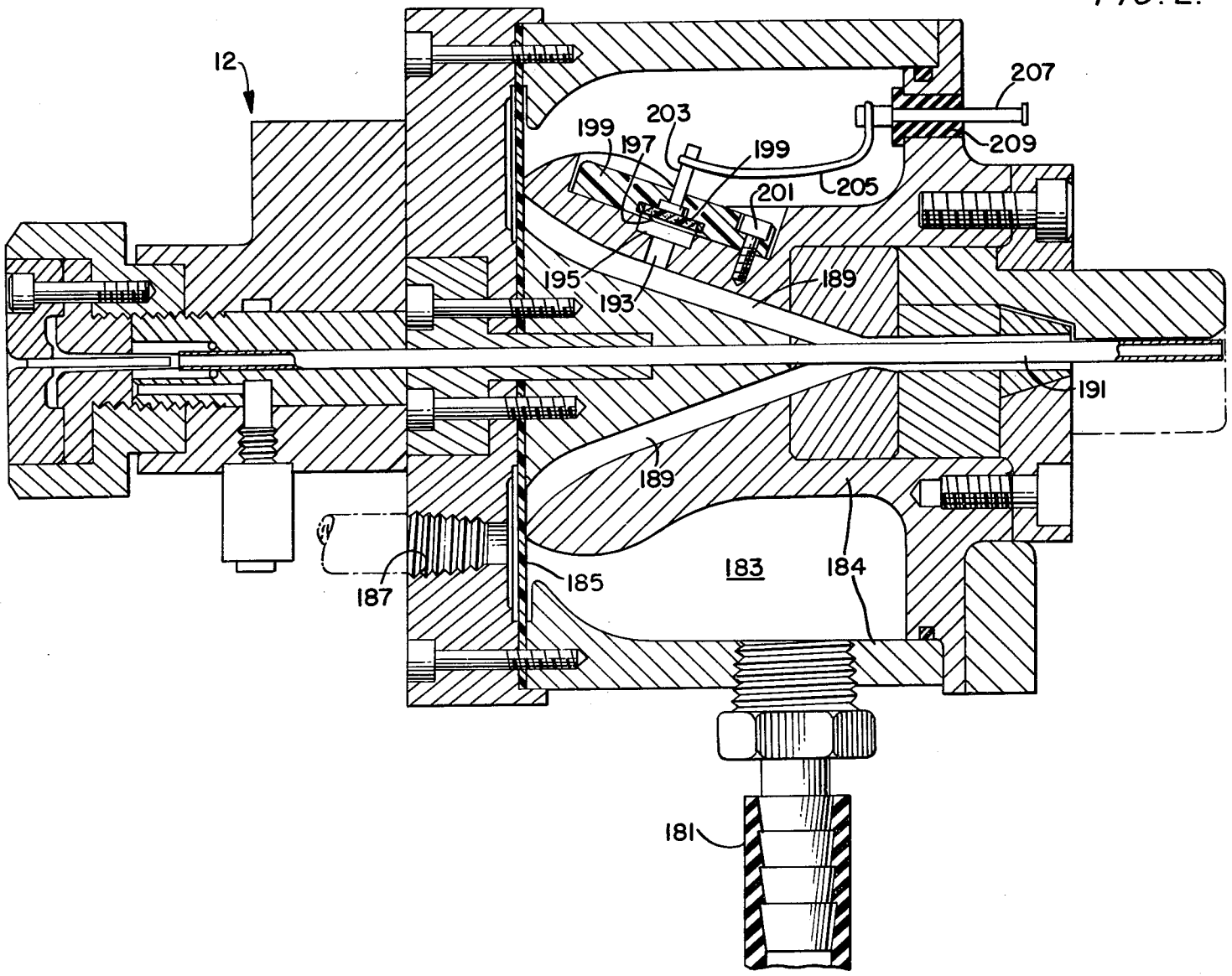
FIG. 2 is an enlarged view taken in cross-section vertically through the yarn insertion nozzle showing the details of the pressure sensing unit associated therewith.

A preferred embodiment for detecting the sudden build-up of fluid pressure within the yarn insertion nozzle N which occurs when the nozzle is "fired" to emit a stream of pressurized fluid around the end of the yarn and transport the same across the shed of the loom is shown in FIG. 2. The nozzle in this embodiment is generally similar to that disclosed in prior application Ser. No. 64,180 in which pressurized air is delivered from a pressurized source via the port 181 into an interior chamber 183 within the nozzle body 184 which constitutes a supply chamber for the pressurized gas. One end of the chamber is closed by means of a flexible diaphragm 185 which is urged to such closed position by means of a pressurized control fluid applied its opposite face by way of a control fluid port 187. By venting the pressure of the pressurized control flud, the diaphragm is freed to move away from the end of the supply chamber and permit the compressed gas therein to exit through the generally conically shaped annular throat 189 of the nozzle. The leading end of the yarn to be projected is threaded through the nozzle throat within a guide tube 191 extending axially through the entire nozzle unit. The details of the manner of controlling the diaphragm action and other features of the nozzle unit itself are better revealed in the description of the above-identified application and may be referred to in that connection.

Along the length of the annular conically contoured nozzle throat passage 189, there is provided a port 193 opening at one end into the throat passage and at the other into an enlarged interior sensing chamber 195. The opposite wall of chamber 195 is closed by means of a flat bimorph crystal wafer 197, seated at its margins over the edges of the chamber walls.

Such crystals are commercially available, and, as is well known, are constructed of two thin plates or layers of piezoelectric material which has the characteristic of emitting an electrical voltage in response to the application thereto of mechanical stress. These two crystal plates are cemented together in such a way that when the crystal laminate is deflected by the application of mechanical force in a direction perpendicular to the starting plane thereof, the crystal laminage emits a momentary electrical voltage with a positive polarity and when the crystal returns to its original condition upon the removal of the applied mechanical force, it emits an electrical voltage of negative polarity. One commercial source of such crystals is Vernitron Piezoelectric Division, 232 Forbes Road, Bedford, Ohio, under the identification of catalog number 60873. The crystal employed here is of generally square configuration, although other configurations are equally suitable. On the back side of bimorph wafer 197 opposite the sensing chamber 195 is a compressible conductive foam pad 199 which is compressed against the wafer to hold the latter in place by a dielectric cap 199 fastened by means of bolts toe the nozzle body 184. An electrical connector 203 extends through the dielectric cap into conductive contact with the conductive foam pad and an electrical lead 205 connects this connector to a connector 207 extending through the end wall of the nozzle body within a dielectric sleeve 209. The exterior end of connector 207 serves as a terminal for one end of an electrical lead (not shown) connecting the same to an appropriate control circuit not shown, but preferably that disclosed in the above cross-referenced patent.

The operation of the nozzle sensing unit is as follows. When the diaphragm 185 opens and releases fluid from chamber 183, fluid pressure builds up within the nozzle passageway 189 and finds its way through port 193 into sensing chamber 195 to be applied against the bimorph wafer 197. The bimorph deflects in response to such applied pressure and generates an electrical signal incidental to such deflection which can be transmitted through the connectors and leads to the remainder of the circuit.

While it is preferred that a compressible gas, such as air, be employed as the yarn propulsion medium, it will be apparent that the function of the sensing unit is not limited to a compressible gas but will be equally effective with any pressurized media, whether aqueous or liquid.

Figure 3:
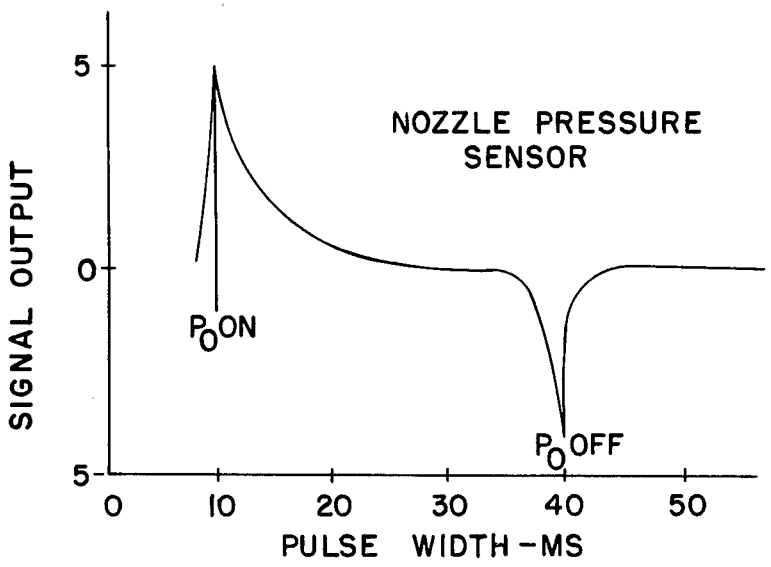
FIG. 3 is a graph showing an oscillograph trace of a typical acceptable pattern for the output of the nozzle sensing unit N, measured against time.

There is shown in the bottom of FIG. 3 an oscilloscope trace for a typical output signal from the pressure sensing element in the nozzle N. Thus, when the nozzle is pressurized at $P_o$, a sharp initiation pulse is emitted by the bimorph crystal and appears in the trace in the form of the peak designated "$P_o$ ON" which tapes off once the bimorph crystal has stabilized in its new position. Then, as the nozzle is depressurized at the end of the insertion phase, the bimorph crystal emits an output pulse of the opposite polarity which appears in the trace at the peak designated "$P_o$ OFF". In this way, the nozzle sensing unit provides a definite indication of both the beginning and end of its pressurization.

What is claimed is:

1. In combination with a weft insertion nozzle which is operative to propel weft yarn in a path from one side of the shed of a loom to the opposite side thereof, means for providing a supply of a pressurized fluid to said nozzle, a throat passage in said nozzle through which the pressurized fluid is expelled to propel said yarn in said path; the combination therewith comprising, electrical signal generating means arranged in said nozzle in communication with said throat passage and adapted to generate a signal in response to the presence of said pressurized fluid in said throat passage, electrical conductor means connected with said electrical generating means and extending exteriorly of said nozzle, and control means operable to admit said pressurized fluid periodically to said throat passage, whereby said electrical signal generating means produces an electrical signal at said conductor means indicative of flow of said pressurized fluid into said passage.

2. The combination as set forth in claim 1 wherein said control means includes a source of pressurized fluid.

3. The combination as set forth in claim 1 wherein said electrical signal generating means generates a voltage and including detector means for precluding production of said electrical signal until voltage of a preset level is produced by said electrical generating means.

4. The combination as set forth in claim 1 wherein said electrical generating means includes a piezoelectric crystal to which the pressure of said pressurized gas is applied.

5. The combination as set forth in claim 4 wherein said signal generating means communicates with said throat passage via a port and said port includes a relatively narrow portion extending from said throat passage, said narrow portion opening into a relatively wide portion proximate to said crystal.

6. The combination as set forth in claim 4 wherein said crystal flexes in a first direction upon the application of said pressurized fluid thereto and in a second direction upon release of said pressurized fluid therefrom, the polarity of the electrical output from said crystal when deflected in said second direction being opposite to the polarity when said crystal is deflected in said first direction, whereby both the rise and fall of fluid pressure within the nozzle passage are indicated.

* * * * *